US008728595B1

(12) United States Patent
Liao

(10) Patent No.: US 8,728,595 B1
(45) Date of Patent: May 20, 2014

(54) BUFFER AIR COLUMN WITH THREE-DIMENSIONAL STRUCTURE

(71) Applicant: Air-Bag Packing Co., Ltd., New Taipei (TW)

(72) Inventor: Yaw-Shin Liao, New Taipei (TW)

(73) Assignees: Air-Bag Packing Co., Ltd., New Taipei (TW); Yaw-Shin Liao, New Taipei (TW)

( * ) Notice: Subject to any disclaimer, the term of this patent is extended or adjusted under 35 U.S.C. 154(b) by 0 days.

(21) Appl. No.: 13/800,377

(22) Filed: Mar. 13, 2013

(30) Foreign Application Priority Data

Feb. 8, 2013 (TW) ..... 102105240 A

(51) Int. Cl.

| | |
|---|---|
| ***B29D 22/00*** | (2006.01) |
| ***B29D 23/00*** | (2006.01) |
| ***B32B 1/04*** | (2006.01) |
| ***B65D 81/02*** | (2006.01) |
| ***B65D 85/00*** | (2006.01) |
| ***B32B 1/08*** | (2006.01) |
| ***B65D 81/05*** | (2006.01) |

(52) U.S. Cl.

CPC ..... *B29D 22/00* (2013.01); *B29D 23/00* (2013.01); *B32B 1/04* (2013.01); *B32B 1/08* (2013.01); *B65D 81/054* (2013.01); *B65D 81/02* (2013.01); *B65D 85/00* (2013.01)

USPC ..... 428/35.2; 428/34.1; 206/522; 383/3

(58) Field of Classification Search

CPC ..... B32B 1/04; B65D 81/054; B65D 81/02; B65D 85/00; B29D 22/00; B29D 23/00; B32B 1/08

USPC ..... 428/34.1, 35.2; 206/522; 383/3

See application file for complete search history.

(56) References Cited

U.S. PATENT DOCUMENTS 8,356,834 B1 * 1/2013 Liao et al. ..... 280/729

* cited by examiner

*Primary Examiner* — Michael C Miggins

(74) *Attorney, Agent, or Firm* — Rabin & Berdo, P.C.

(57) ABSTRACT

A buffer air column with a three-dimensional structure includes a first buffer portion and a second buffer portion. The first buffer portion includes a first air column, a first heat sealing section and a second heat sealing section. The second buffer portion includes a second air column, a first connection side, a second connection side and a corner area. One end of the corner area is connected to the first connection side, the other end is connected to the second connection side, and the corner area is used for abutting against a case body. A buffer slot is formed between the second air column and the first air column, and when an article abuts against the first air column, the first air column buffers and protects the article, and the buffer slot is compressed due to the pressure and assists in buffering and protecting the article.

10 Claims, 10 Drawing Sheets

BUFFER AIR COLUMN WITH THREE-DIMENSIONAL STRUCTURE

CROSS-REFERENCES TO RELATED APPLICATIONS

This non-provisional application claims priority under 35 U.S.C. §119(a) on Patent Application No. 102105240 filed in Taiwan, R.O.C. on 2013 Feb. 8, the entire contents of which are hereby incorporated by reference.

BACKGROUND OF THE INVENTION

1. Technical Field

The present invention relates to an air column apparatus, and particularly to a buffer air column with a three-dimensional structure and a packing case.

2. Related Art

An air sealing body is formed of a material of a resin membrane, which is heat-sealed into a sealing state to form an air column. The air sealing body is provided with an air filling port for filling air. When gas is filled into the air column through the air filling port, the air sealing body can be used in an inner package as a buffer material.

A common air sealing body only provides a single-layer buffer effect, that is, when the air sealing body is pressed by weight of an article, only the gas filled in the air sealing body buffers the pressure. However, when the volume of the article is large and the weight exceeds the weight that the air sealing body can buffer, the article cannot be effectively buffered and protected.

Therefore, a technical issue faced by the inventor of the present invention and persons in technical fields of relevant industries is how to design a sealing body capable of enabling an air sealing body to have multiple buffer effects, to automatically open an air inlet for continuous air filling to shorten the air filling time, to automatically perform air closing in air filling, and to automatically lock the air after the air closing to keep the air from leaking for a long time.

SUMMARY

In view of this, the present invention provides a buffer air column with a three-dimensional structure, including a first buffer portion and a second buffer portion. The first buffer portion includes a first air column, a first heat sealing section and a second heat sealing section. The second buffer portion includes a second air column, a first connection side, a second connection side and a corner area. The first connection side is located at a plurality of second air columns, one end of the first connection side is connected to the first heat sealing section, and a first angle is formed between the first connection side and the first air column. The second connection side is located at the second air column, and is disposed at an interval from the first connection side. One end of the second connection side is connected to the second heat sealing section, and a second angle is formed between the second connection side and the first air column. One end of the corner area is connected to the first connection side, the other end is connected to the second connection side, and the corner area is used for abutting against an inner surface of a case body. A buffer slot is formed between the second air column and the first air column, and when an article abuts against the first air column, the first air column buffers and protects the article, and the buffer slot is compressed due to the pressure and assists in buffering and protecting the article.

In the present invention, by means of the buffer air column with a three-dimensional structure, when an air column apparatus is pressed by an article, the buffer slot between the corner area and the first air column generates a first buffer effect, that is, a space in the buffer slot provides a buffer distance when being pressed by the article.

Furthermore, the gas expanding in the first air column and the second air column provides an elastic effect, thereby generating a second buffer effect. In addition, the air column apparatus can automatically open an air inlet for continuous air filling, thereby shortening the air filling time; can automatically perform air closing in air filling; and can automatically lock the air after the air closing, thereby keeping the from leaking for a long time.

Preferred embodiments of the present invention and efficacies thereof are described in the following with reference to the accompanying drawings.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
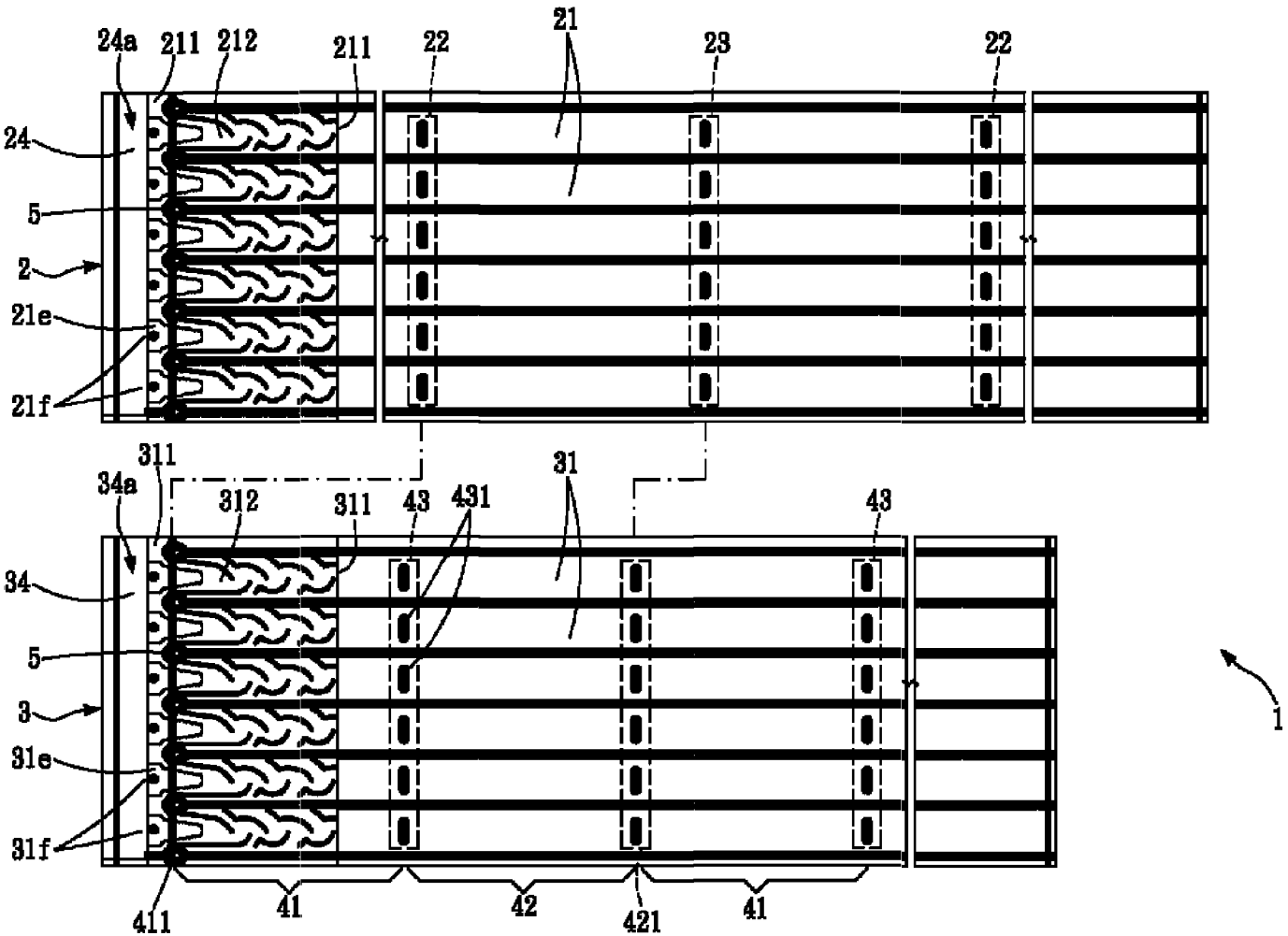
FIG. 1 is a schematic plane view of a first embodiment before air filling according to the present invention.
Figure 2:
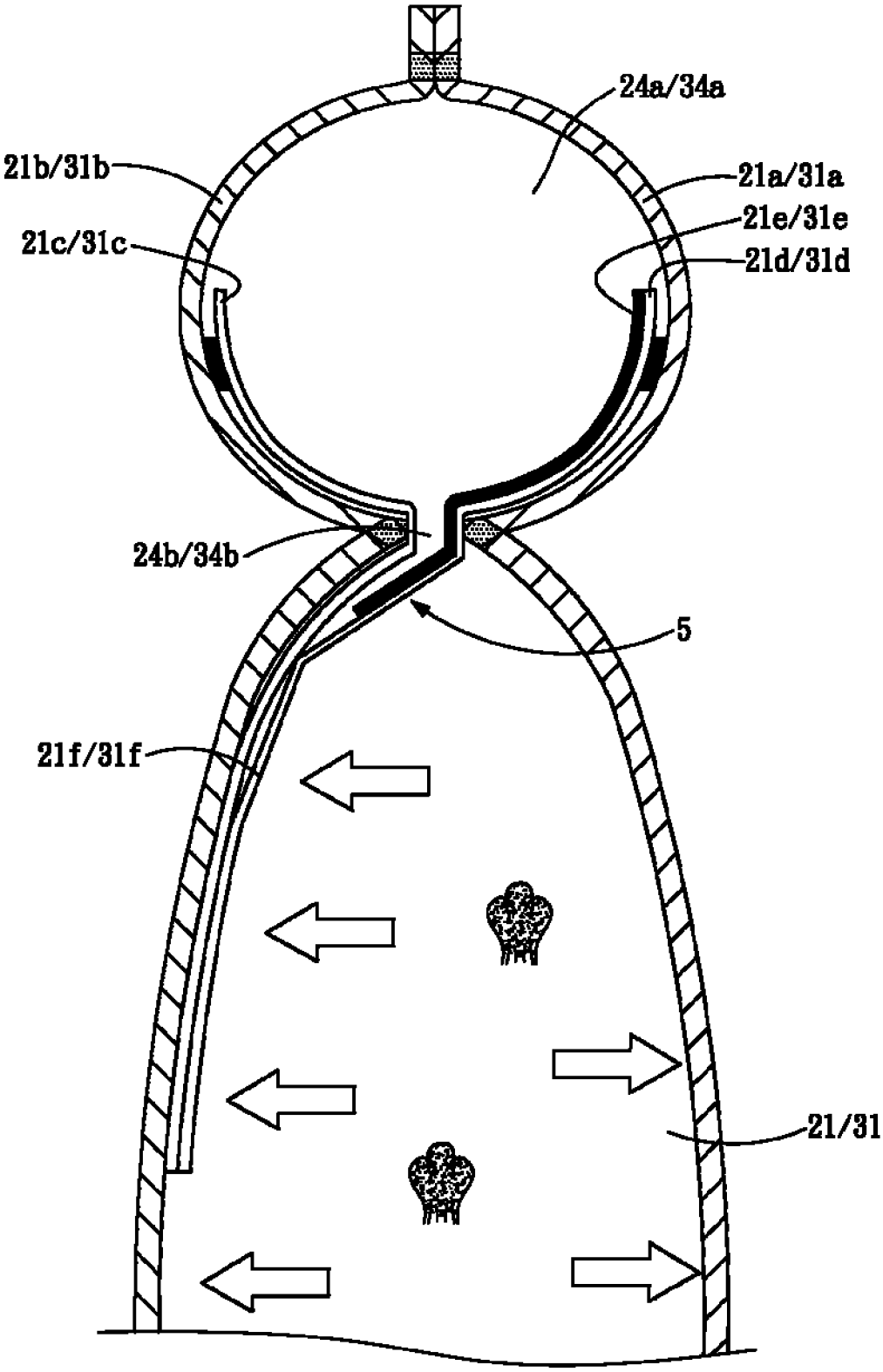
FIG. 2 is a schematic partial side view (I) of the first embodiment in air filling according to the present invention.
Figure 3:
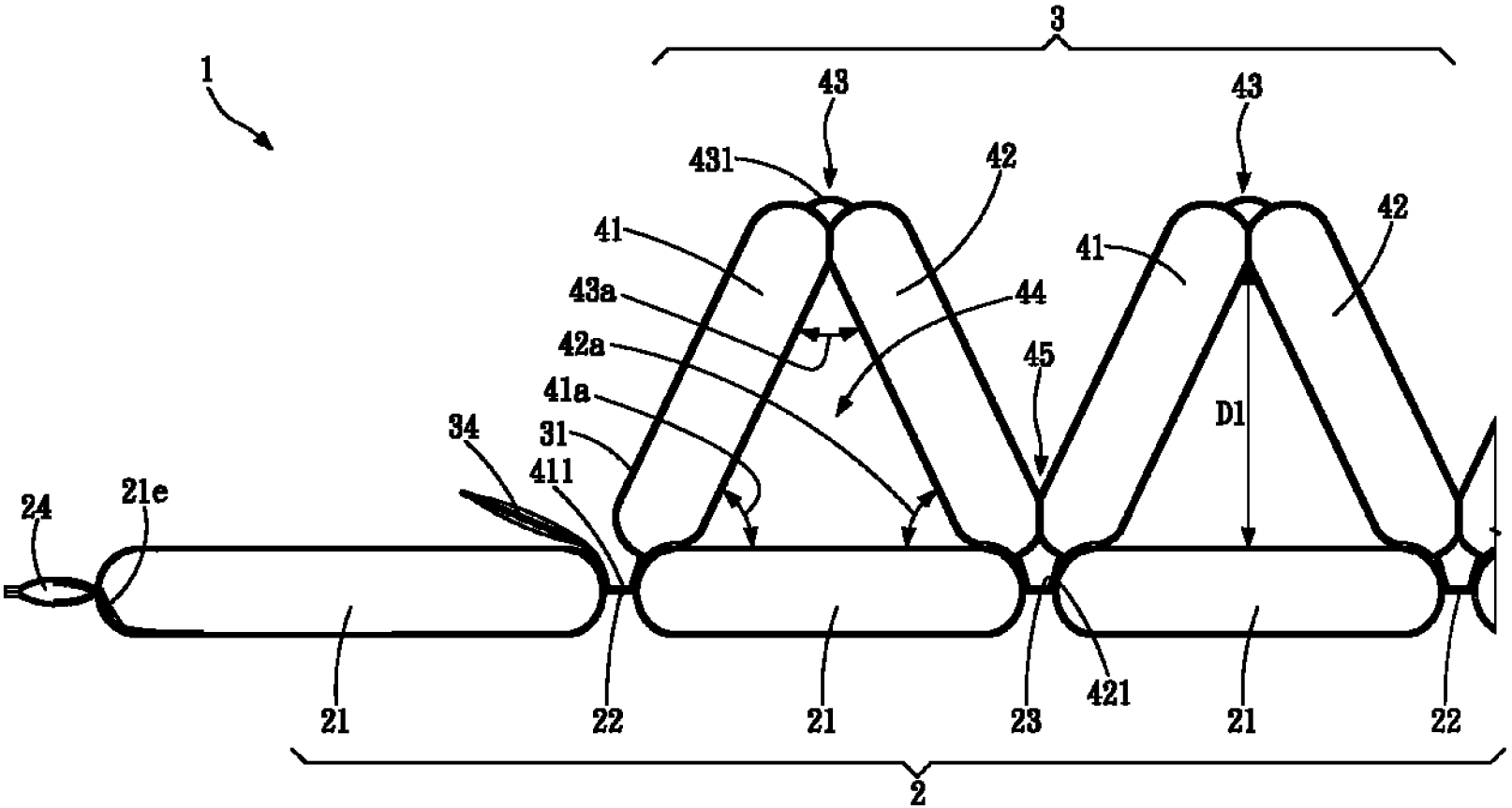
FIG. 3 is a schematic partial side view (II) of the first embodiment in air filling according to the present invention.

Please refer to FIG. 1, FIG. 2 and FIG. 3, FIG. 1, FIG. 2 and FIG. 3 which show a first embodiment of a buffer air column apparatus with multiple buffer effects of the present invention.

The air column apparatus 1 of the present invention includes a first buffer portion 2 and a second buffer portion 3. The first buffer portion 2 mainly has a plurality of first air columns 21, a plurality of first heat sealing sections 22 and a plurality of second heat sealing sections 23. Here, please refer to FIG. 8 and FIG. 9, in which the first buffer portion 2 is bent to form an accommodation space (that is, a box body is formed by the first buffer portion 2), for accommodating an article 9, so that the first buffer portion 2 is used as an outer case to cover the article 9, but the present invention is not limited thereto.

As shown in FIG. 1 and FIG. 2, the plurality of first air columns 21 includes a first surface and a second surface opposite each other. Here, the first surface faces the accommodation space. In addition, the plurality of first air columns 21 has two outer membranes 21*a* and 21*b*, two inner membranes 21*c* and 21*d*, and a heat resisting material 21*e*. Here, the two outer membranes 21*a* and 21*b* are superposed. The two inner membranes 21*c* and 21*d* are located between the two outer membranes 21*a* and 21*b*, and are placed at positions slightly lower than inner tops of the two outer membranes 21*a* and 21*b*. The width of the two inner membrane 21*c* and 21*d* is the same as that of the two outer membranes 21*a* and 21*b*, and the length of the two inner membrane 21*c* and 21*d* is less than that of the outer membranes 21*a* and 21*b*. Each inner membrane has a first side edge 211 and a second side edge 212 opposite each other. In addition, a plurality of heat resisting materials 21*e* is coated, at an interval, between the first side edges 211 of the two inner membranes 21*c* and 21*d* and (as shown in FIG. 2), so that the heat resisting material 21*e* may serve as an air circulation path.

The two outer membranes 21*a* and 21*b* and the two inner membranes 21*c* and 21*d* are adhered by means of heat sealing, so an air filling channel 24 for gas circulation is formed in the two outer membranes 21*a* and 21*b*, and an air filling port 24*a* is formed at an end of the air filling channel 24. The two outer membranes 21*a* and 21*b* are adhered along straight heat sealing lines, so as to form the plurality of first air columns 21 between the two outer membranes 21*a* and 21*b*. After the heat resisting material 21*e* is coated between the two inner membranes 21*c* and 21*d*, the two inner membranes 21*c* and 21*d* are adhered by means of heat sealing, and a plurality of air inlets 24*b* is formed at a junction of heat sealing lines, in which each air inlet 24*b* corresponds to each of the plurality of first air columns 21. A continuous air valve for filling air to the plurality of first air columns 21 at the same time is formed by the two inner membranes 21*c* and 21*d*.

In use, a user only needs to blow air to the air filling port 24*a*, and after the air filling channel 24 is expanded by the gas entering the air filling port 24*a*, the two outer membranes 21*a* and 21*b* are pulled outwards in the longitudinal direction, so as to automatically open the air inlets 24*b* (as shown in FIG. 2). The two inner membranes 21*c* and 21*d* of an air guide channel 21*f* are pulled outwards, so that a notch formed after the two inner membranes 21*c* and 21*d* are pre-coated with the heat resisting material 21*e* and then heat-sealed is naturally opened. Since the air inlets 24*b* are automatically opened, that is, one air filling channel 24 can simultaneously fill air into the plurality of first air columns 21 without positioning the air inlets 24*b* for air filling, thereby shortening the air filling time. Furthermore, since the plurality of first air columns 21 is independent of each other, even some first air columns 21 are damaged, the overall buffer effect of the air sealing body is not affected. In addition, the user only needs to blow air to the air filling port 24*a* to fill air into the plurality of first air columns 21 without using a high-pressure air filler, so that the air filling operation is simple and convenient.

In this embodiment, a plurality of heat sealing blocks 5 is formed at a predetermined position of a side edge of the plurality of air inlets 24*b*, sites with no heat sealing blocks 5 set are expanded by the filled air, and sites with the heat sealing blocks 5 set are not filled with air and are not expanded. The heat sealing blocks 5 press the two inner membranes 21*c* and 21*d*, and are pulled outwards in the longitudinal direction with the two outer membranes 21*a* and 21*b* by the two inner membranes 21*c* and 21*d*, so that the air inlets 24*b* are automatically opened.

After the filled gas enters the plurality of first air columns 21 via the air guide channels 21*f* and the air inlets 24*b*, due to the inner pressure of the gas in the plurality of first air columns 21, the second side edges 212 of the two inner membranes 21*c* and 21*d* are pressed, the two inner membranes 21*c* and 21*d* are attached together, and the plurality of first air columns 21 is closed, so that the gas is not leaked, thereby achieving the air closing effect. Here, the two inner membranes 21*c* and 21*d* are pressed by the gas, and are suspended in the plurality of first air columns 21, or the two inner membranes 21*c* and 21*d* may be adhered to the outer membrane 21*a* or 21*b*. After the gas enters the plurality of first air columns 21, the two inner membranes 21*c* and 21*d* are pressed and attached to the outer membrane 21*a* or 21*b*, so that the plurality of first air columns 21 is closed.

As shown in FIG. 1, the plurality of first air columns 21 is heat-sealed by the plurality of first heat sealing sections 22 by means of heat sealing, transverse heat sealing lines are formed on the plurality of first air columns 21. Here, the plurality of first heat sealing sections 22 forms a plurality of heat sealing points spaced at an interval.

As shown in FIG. 1, the plurality of first air columns 21 is heat-sealed by the plurality of second heat sealing sections 23 by means of heat sealing, and the plurality of second heat sealing sections 23 is disposed at an interval from the plurality of first heat sealing sections 22. Here, the plurality of second heat sealing sections 23 forms a plurality of heat sealing points spaced at an interval.

Figure 8:
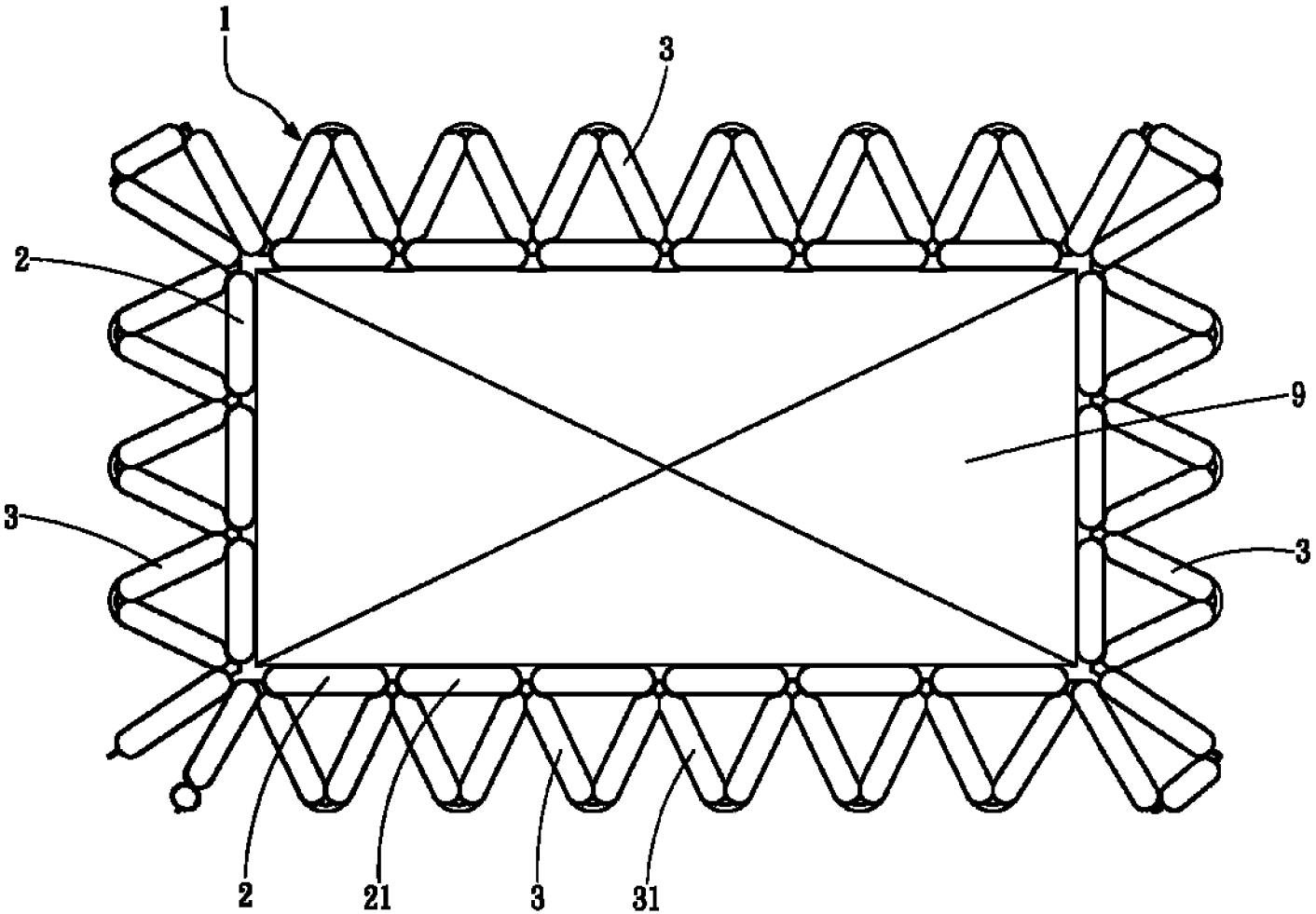
FIG. 8 is a schematic side view (I) of a formed outer case according to the present invention.
Figure 9:
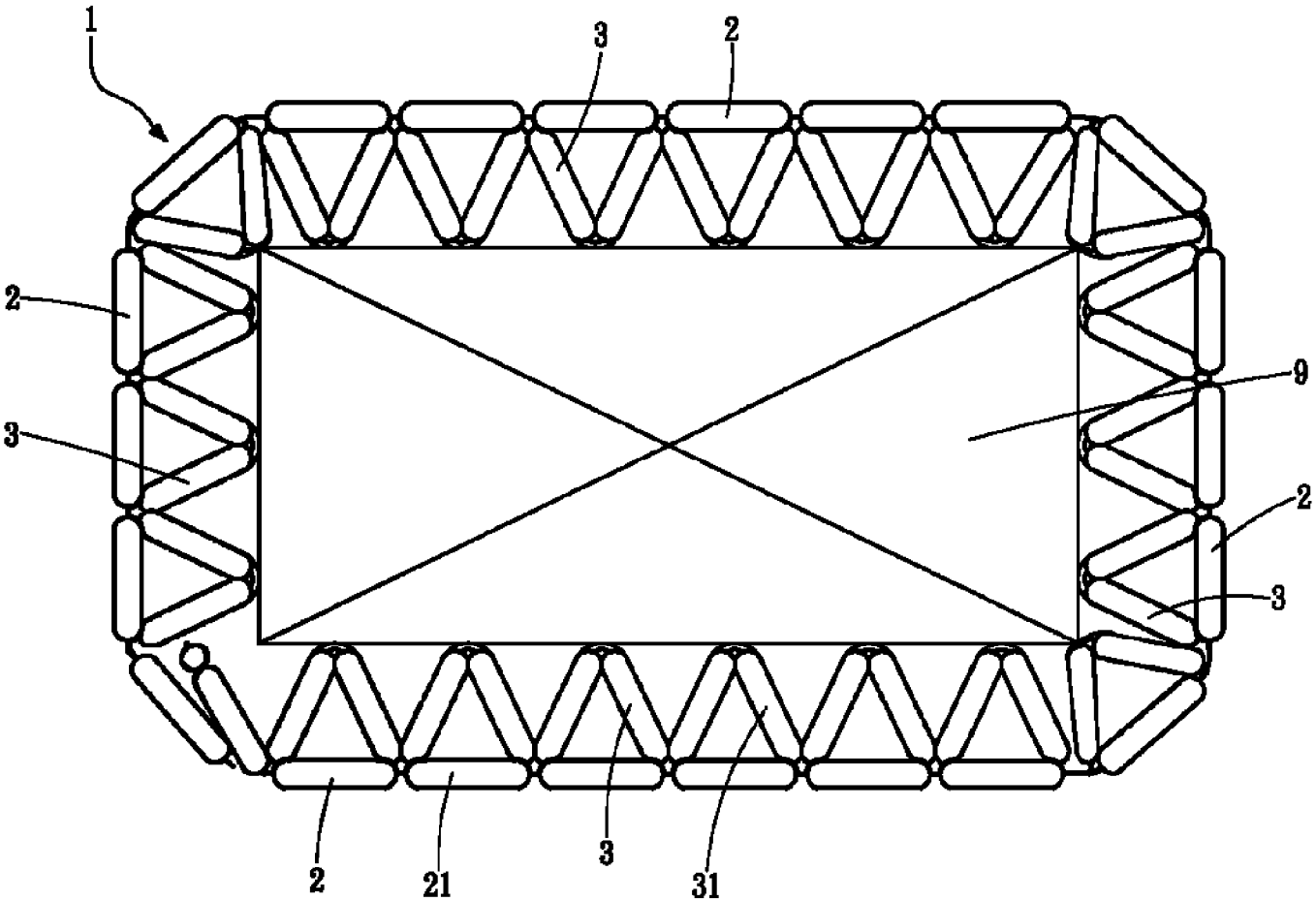
FIG. 9 is a schematic side view (II) of the formed outer case according to the present invention.

As shown in FIG. 1 and FIG. 2, the second buffer portion 3 are stacked on the first buffer portion 2, the second buffer portion 3 has a plurality of second air columns 31. Here, the plurality of second air columns 31 has a structure similar to that of the plurality of first air columns 21, but the present invention is not limited thereto. Here, the plurality of second air columns 31 is stacked on a second surface of the plurality of first air columns 21 (as shown in FIG. 8). However, in some implementation aspects, the plurality of second air columns 31 is stacked on a first surface of the plurality of first air columns 21 (as shown in FIG. 9). The second buffer portion 3 mainly forms a plurality of first connection sides 41, a plurality of second connection sides 42 and a corner area 43 on the plurality of second air columns 31.

As shown in FIG. 2 and FIG. 3, the plurality of second air columns 31 has two outer membranes 31*a* and 31*b*, two inner membranes 31*c* and 31*d* and a heat resisting material 31*e*. Here, the two outer membranes 31*a* and 31*b* are superposed. The two inner membranes 31*c* and 31*d* are located between the two outer membranes 31*a* and 31*b*, and are disposed at positions slightly lower than inner tops of the two outer membranes 31*a* and 31*b*. The width of the two inner membranes 31*c* and 31*d* is the same as that of the two outer membranes 31*a* and 31*b*, and the length of the two inner membranes 31*c* and 31*d* is less than that of the outer membranes 31*a* and 31*b*. Each inner membrane has a third side edge 311 and a fourth side edge 312 opposite each other. In addition, a plurality of heat resisting materials 31*e* is coated at an interval between the third side edges 311 of the two inner membranes 31*c* and 31*d* (as shown in FIG. 2), so that the heat resisting material 31*e* may serve as an air circulation path.

The two outer membranes 31*a* and 31*b* and the two inner membranes 31*c* and 31*d* are adhered by means of heat sealing, so an air filling channel 34 for gas circulation is formed in the two outer membranes 31*a* and 31*b*, and an air filling port 34*a* is formed at an end of the air filling channel 34. The two outer membranes 31*a* and 31*b* are adhered along straight heat sealing lines, so as to form the plurality of second air columns 31 between the two outer membranes 31*a* and 31*b*. After the heat resisting material 31*e* is coated between the two inner membranes 31*c* and 31*d*, the two inner membranes 31*c* and 31*d* are adhered by means of heating sealing, and a plurality of air inlets 34*b* is formed at a junction of the heat sealing lines, in which each air inlet 34*b* corresponds to each of the plurality of second air columns 31. A continuous air valve for filling air to the plurality of second air columns 31 at the same time is formed by the two inner membranes 31*c* and 31*d*.

In use, a user only needs to blow air to the filling port 34*a*, and after the air filling port 34*a* is expanded by the gas entering the air filling channel 34, the two outer membranes 31*a* and 31*b* are pulled outwards in the longitudinal direction, so as to automatically open the air inlets 34*b* (as shown in FIG. 2). The two inner membranes 31*c* and 31*d* of an air guide channel 31*f* are pulled outwards, so that a notch formed after the two inner membranes 31*c* and 31*d* are pre-coated with the heat resisting material 31*e* and then heat-sealed is naturally opened. Since the air inlets 34*b* are automatically opened, that is, one air filling channel 34 can fill simultaneously air into the plurality of second air columns 31 without positioning the air inlet 34*b* for air filling, thereby shortening the air filling time. Furthermore, since the plurality of second air columns 31 is independent of each other, even some second air columns 31 are damaged, the overall buffer effect of the air sealing body is not affected. In addition, the user only needs to blow air to the air filling port 34*a* to fill air into the plurality of second air columns 31 without using a high-pressure air filler, so that the air filling operation is simple and convenient.

In this embodiment, a plurality of heat sealing blocks 5 is formed at a predetermined position of a side edge of the plurality of air inlets 34*b*, sites with no heat sealing block 5 set is expanded by the filled air, and sites with the heat sealing block 5 set are not filled with air and are not expanded. The heat sealing blocks 5 press the two inner membranes 31*c* and 31*d*, and are pulled outwards in the longitudinal direction with the two outer membranes 31*a* and 31*b* by the two inner membrane 31*c* and 31*d*, so that the air inlets 34*b* are automatically opened.

After the filled gas enters the plurality of second air columns 31 via the air guide channel 31*f* and the air inlets 34*b*, due to the inner pressure of the gas in the plurality of second air columns 31, the fourth side edges 312 of the two inner membranes 31*c* and 31*d* are pressed, the two inner membranes 31*c* and 31*d* are attached together, and the plurality of second air columns 31 is closed, so that the gas is not leaked, thereby achieving the air closing effect. Here, the two inner membranes 31*c* and 31*d* are pressed by the gas, and are suspended in the plurality of second air columns 31, or the two inner membranes 31*c* and 31*d* may be adhered to the outer membrane 31*a* or 31*b*. After the gas enters the plurality of second air columns 31, the two inner membranes 31*c* and 31*d* are pressed and attached to the outer membrane 31*a* or 31*b*, so that the plurality of second air columns 31 is closed.

As shown in FIG. 1, the plurality of first connection sides 41 is located at the plurality of second air columns 31, an end of the plurality of the first connection sides 41 is connected to the plurality of first heat sealing sections 22. Here, a first section of heat sealing line 411 is formed at an end of each of the plurality of first connection sides 41, that is, a whole first heat sealing line 411 is connected to the heat resisting material 31*e*. The first section of heat sealing line 411 is located at a side of the air filling port 34*a*, and additionally, the plurality of first heat sealing sections 22 is heat-sealed by the first section of heat sealing line 411 at the plurality of first connection sides 41 by means of heat sealing. In addition, a first angle 41*a* is formed between the plurality of first connection sides 41 and the plurality of first air columns 21 of the first buffer portion 2.

As shown in FIG. 1, the plurality of second connection sides 42 is located at the plurality of second air columns 31, and is disposed at an interval from the plurality of first connection sides 41. An end of the plurality of second connection sides 42 is connected to the plurality of second heat sealing sections 23. Here, a second section of heat sealing line 421 is formed at an end of each of the plurality of second connection sides 42, that is, a plurality of heat sealing points disposed at an interval from each other is connected to the plurality of second air columns 31. A corner area 43 (that is, an area that is not heat-sealed with the plurality of first air columns 21), is formed between the second section of heat sealing line 421 and the first section of heat sealing line 411. In addition, the plurality of second heat sealing sections 23 is heat-sealed by the second section of heat sealing line 421 at the plurality of second connection sides 42 by means of heat sealing. Furthermore, a second angle 42*a* is formed between the plurality of second connection sides 42 and the plurality of first air columns 21 of the first buffer portion 2.

Figure 6A:
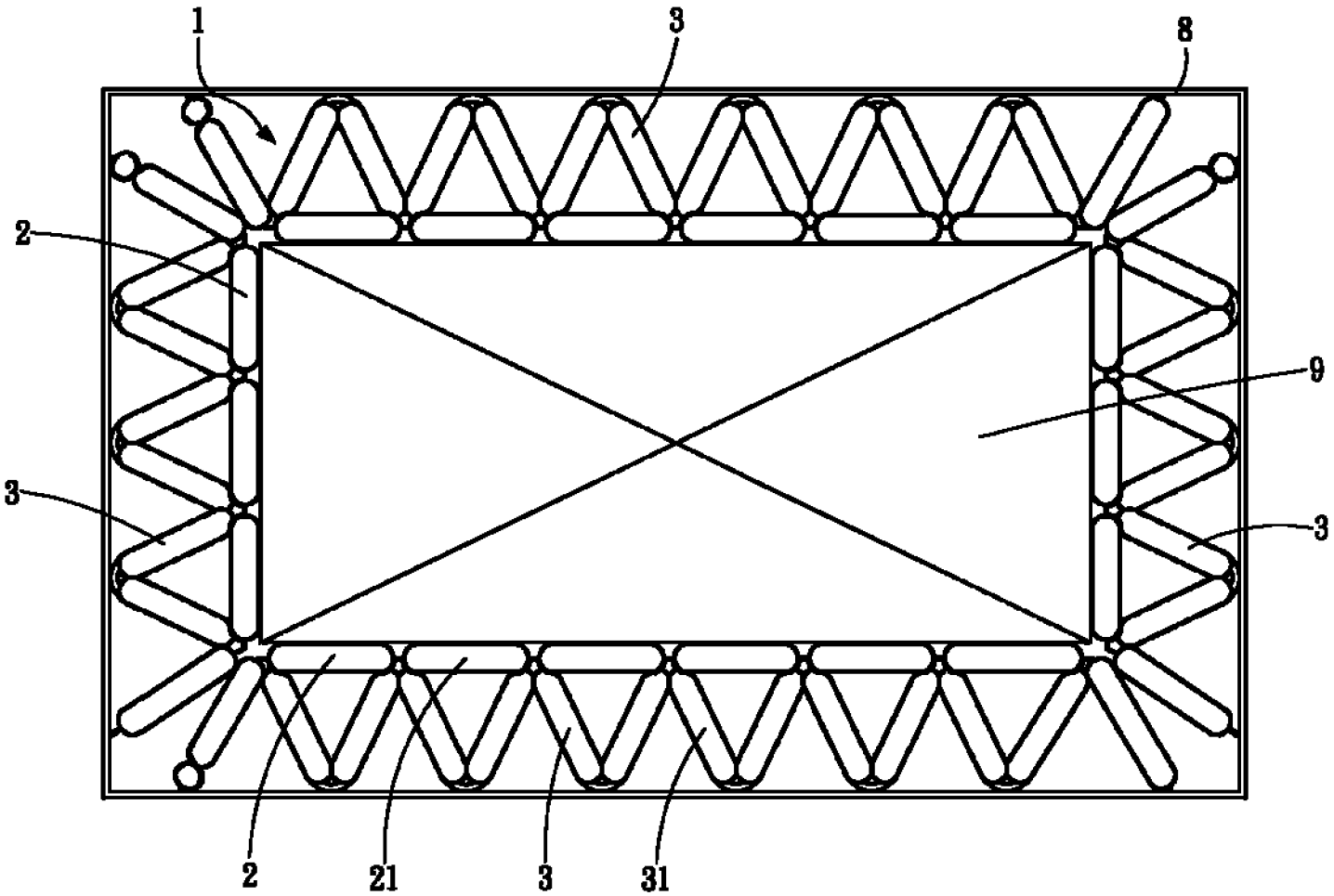
FIG. 6A is a schematic side view of the present invention in use.

As shown in FIG. 3, one end of the corner area 43 is connected to the plurality of first connection sides 41, and the other end is connected to the plurality of second connection sides 42. Here, the corner area 43 is used for abutting against an inner surface of a case body 8 (as shown in FIG. 6A), but the present invention is not limited thereto. In some implementation aspects, the corner area 43 is used for abutting against an article 9 (as shown in FIG. 9). Here, the corner area 43 has a first turning section 431, that is, the first turning section 431 is a discontinuous thin heat sealing line formed after heat sealing and connected to the plurality of second air columns 31. A buffer slot 44 is formed between the plurality of second air columns 31 and the first air column 21. In this embodiment, a third angle 43*a* is formed at a junction of the corner area 43, the plurality of first connection sides 41 and the plurality of second connection sides 42, and faces the plurality of first air columns 21. Here, projections of the cross sections of the first buffer portion 2 and the second buffer portion 3 form a triangle (it is noted that a triangular structure is formed), but the present invention is not limited thereto.

As shown in FIG. 3, here, the second buffer portion 3 further includes a turning area 45 (that is, the second section of heat sealing line 421), one end of the turning area 45 is connected to a plurality of second connection sides 42, and the other end is connected to another plurality of first connection sides 41 (that is, the plurality of first connection sides 41 is connected to a first plurality of first connection sides 41, the plurality of second connection sides 42 is connected to a second plurality of first connection sides 41). In this way, the turning area 45 is bent and is connected to the plurality of second heat sealing sections 23, so that plurality of second connection sides 42 may be continuously connected to another plurality of first connection sides 41. The plurality of first connection sides 41 is heat-sealed on the plurality of first air columns 21, that is, projections of cross sections of the first buffer portion 2 and the second buffer portion 3 form a plurality of triangular structures (that is, a bridge-shaped buffer air column apparatus 1 is formed).

Figure 4:
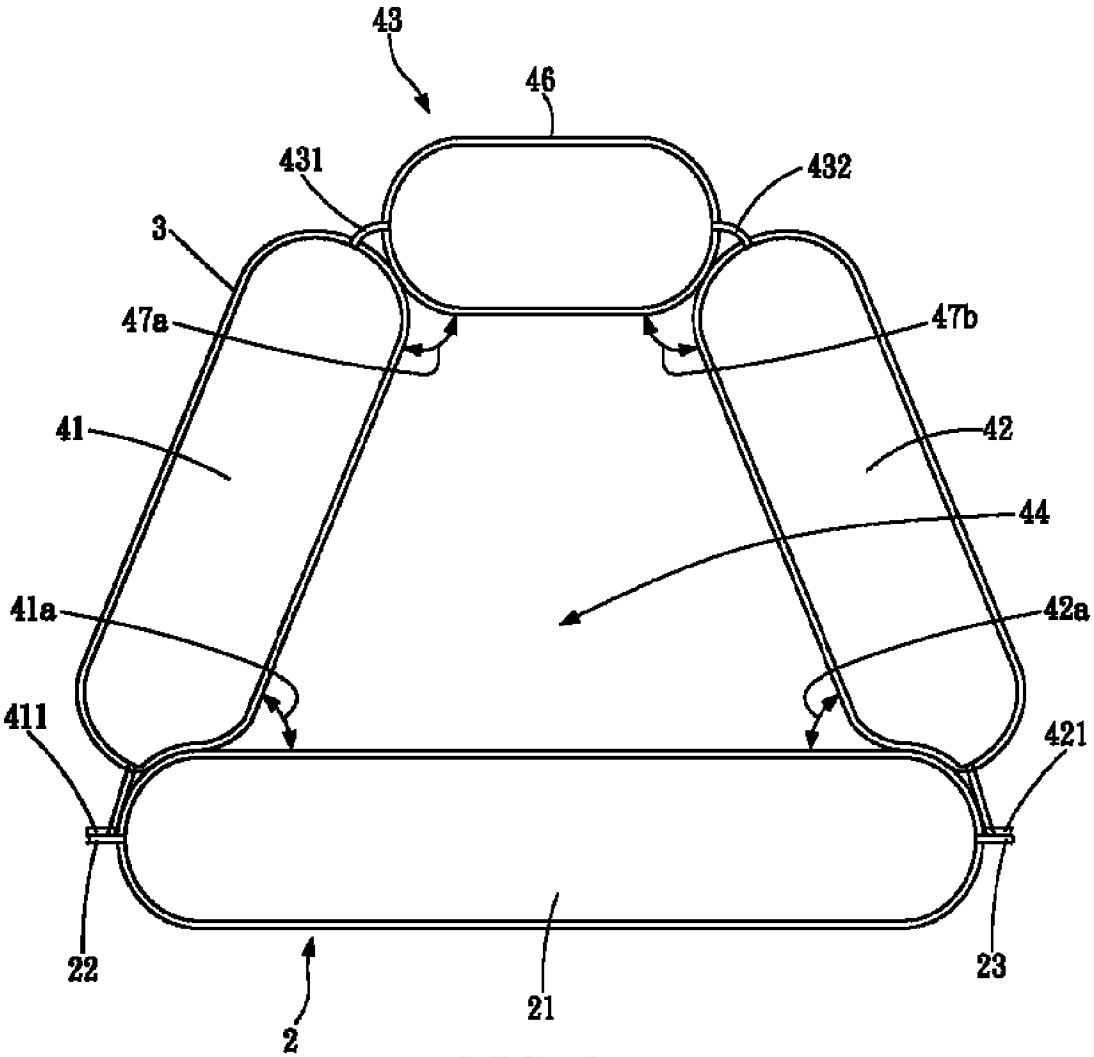
FIG. 4 is a schematic partial side view (I) of another aspect of a second buffer portion according to the present invention.

As shown in FIG. 4, in some implementation aspects, the air column apparatus 1 further includes a third connection side 46. Here, the length of a projection of a cross section of the third connection side 46 is shorter than the length of projections of cross sections of the plurality of first connection sides 41. One end of the third connection side 46 is connected to the plurality of first connection sides 41, and the other end is connected to the plurality of second connection sides 42. Furthermore, the third connection side 46 is substantially parallel to the plurality of first air columns 21, but the present invention is not limited thereto.

Figure 5:
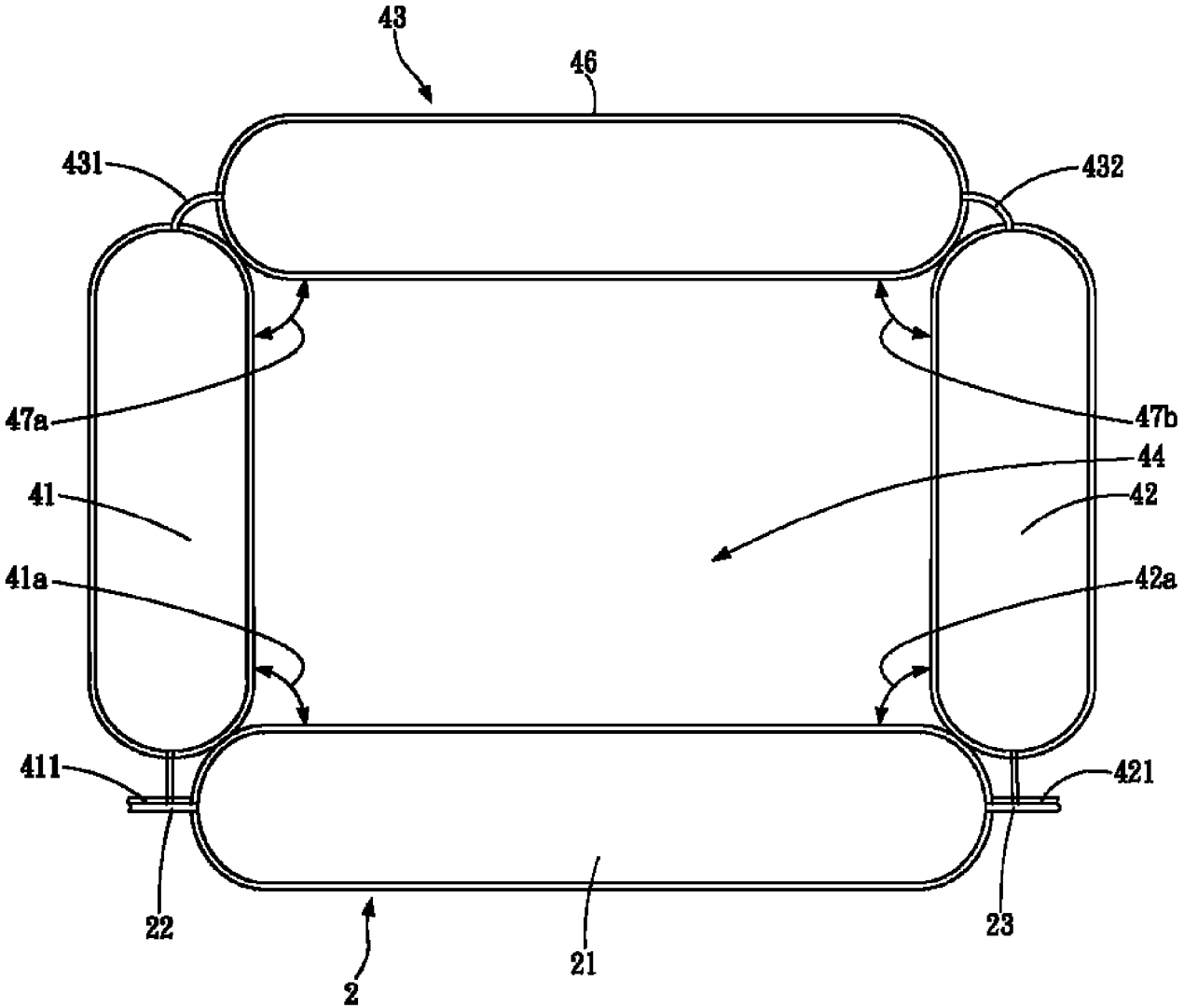
FIG. 5 is a schematic partial side view (II) of another aspect of the second buffer portion according to the present invention.

As shown in FIG. 4, the projections of the cross sections of the first buffer portion 2 and the second buffer portion 3 form a trapezoid, but the present invention is not limited thereto. In some embodiments, the projections of the cross sections of the first buffer portion 2 and the second buffer portion 3 may form a square (as shown in FIG. 5). Here, the length of the projection of the cross section of the third connection side 46 is equal to the length of a projection of a cross section of the plurality of first air columns 21 (that is, between the plurality of first heat sealing sections 22 and the plurality of second heat sealing sections 23). However, in some implementation aspects, the projections of the cross sections of the first buffer portion 2 and the second buffer portion 3 may also form a triangular structure, a trapezoidal structure, or a structure of other shapes.

As shown in FIG. 4, two ends of the third connection side 46 respectively have the first turning section 431 and the second turning section 432, where the first turning section 431 is connected to the plurality of first connection sides 41, and the second turning section 432 is connected to the plurality of second connection sides 42. In this embodiment, the first turning section 431 and the second turning section 432 are discontinuous thin heat sealing lines formed after heat sealing.

As shown in FIG. 4, in this implementation aspect, a fourth angle 47*a* is formed at a junction of the third connection side 46 and the plurality of first connection sides 41, a fifth angle 47*b* is formed at a junction of the third connection side 46 and the plurality of second connection sides 42, and the fourth angle 47*a* and the fifth angle 47*b* face the plurality of first air columns 21.

Figure 6B:
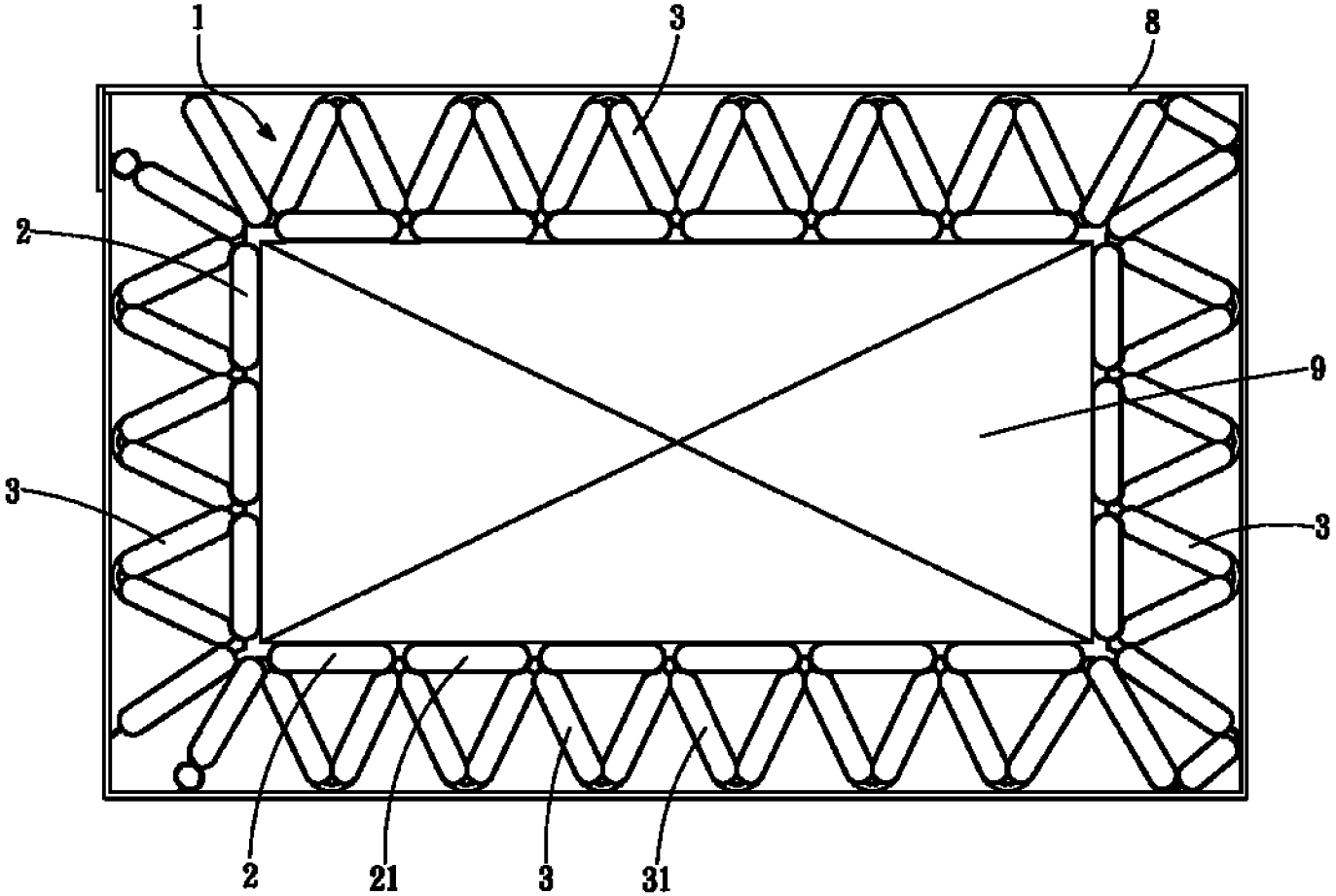
FIG. 6B is a schematic side view of the present invention in use.
Figure 7:
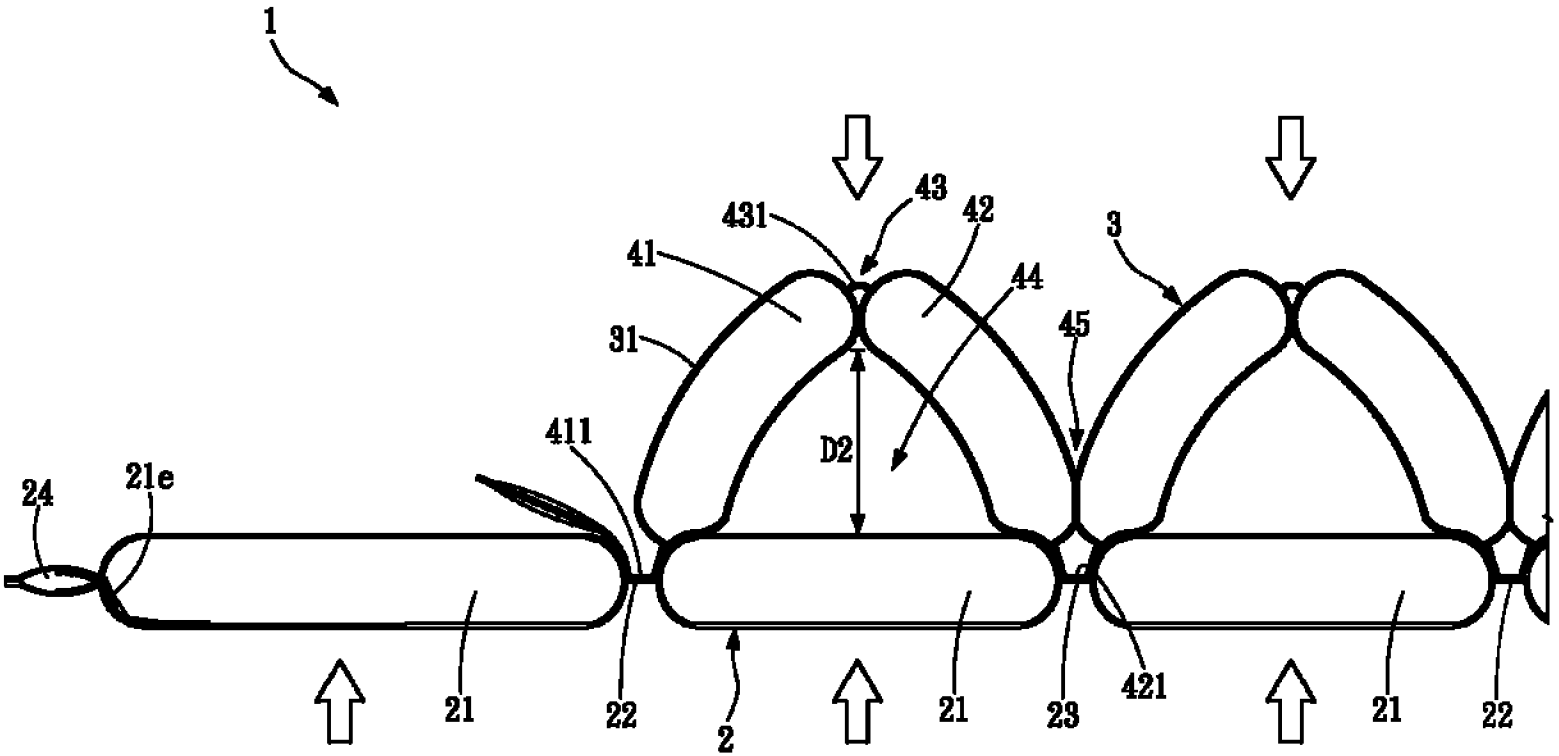
FIG. 7 is a schematic partial side view of the present invention in use.

As shown in FIG. 6A, FIG. 6B and FIG. 7, FIG. 6A is a schematic top view with a case body, FIG. 6B is a schematic side view with the case body, and FIG. 7 is a schematic partial side view in use. Here, in combination of the plurality of first buffer portions 2, the first buffer portions 2 with different lengths are bent to form an accommodation space (that is, a box body is formed by the first buffer portions 2), so as to encircle the article 9. The user may place the air column apparatus 1 in the case body 8, so that the air column apparatus 1 forms an inner case, for bearing the external article 9. Here, the article 9 may be various products (for example, a host shell and a notebook computer).

In this embodiment, the second surface of the plurality of first air columns 21 abuts against the inner surface of the case body 8. When the article 9 abuts against the plurality of first air columns 21, the plurality of first air columns 21 buffers and protects the article 9, and the buffer slot 44 is compressed due to the pressure and assists in buffering and protecting the article 9 (as shown in FIG. 8). The situation that the article 9 abuts against the plurality of first air columns 21 is merely an example. In some implementation aspects, the article 9 may abut against the plurality of second air columns 31. When the article 9 abuts against the plurality of second air columns 31, the plurality of second air columns 31 buffers and protects the article 9, and the buffer slot 44 is compressed due to the pressure and assists in buffering and protecting the article 9 (as shown FIG. 9).

In this embodiment, when the corner area 43 or the plurality of first air columns 21 of the air column apparatus 1 is pressed by the weight of the article 9, the distance of the space in the buffer slot 44 is compressed into a buffer height D2, that is, the distance of the space before compression is referred to as a no-buffer height D1 (that is, a preset height, as shown in FIG. 3), and the distance of the space after compression is referred to as a buffer height D2 (as shown in FIG. 7). Here, the buffer height D2 is less than the no-buffer height D1. In this way, the buffer slot 44 generates a first buffer effect. In addition, the gas expanding in the plurality of first air columns 21 and the plurality of second air columns 31 provides an elastic effect, thereby generating a second buffer effect. That is to say, when the article 9 abuts against the air column apparatus 1, multiple buffer effects are provided by means of the distance of the space of the buffer slot 44 and the elastic structures of the plurality of first air columns 21 and the plurality of second air columns 31. Furthermore, the air column apparatus 1 is bent by the plurality of second air columns 31 and is connected to the plurality of first air columns 21, thereby forming a buffer air column with a three-dimensional structure.

In this embodiment, the article 9 abuts against the first buffer portion 2, so the pressing direction of the article 9 is a direction toward the first buffer portion 2. When the article 9 presses in a direction of the first buffer portion 2, the second buffer portion 3 on the other side abuts against the case body 8, but this manner is merely used for an example. In some implementation aspects, the article 9 may press in a direction towards the second buffer portion 3, that is, when the article 9 presses in a direction of the second buffer portion 3, the first buffer portion 2 on the other side abuts against the case body 8.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A buffer air column with a three-dimensional structure, comprising:

a first buffer portion, bent to form an accommodation space, used for accommodating an article, and comprising:

a plurality of first air columns, each comprising a first surface and a second surface opposite each other, wherein the first surface faces the accommodation space;

a plurality of first heat sealing sections, for heat-sealing the first air columns;

a plurality of second heat sealing sections, for heat-sealing the first air columns, and disposed at an interval from the first heat sealing sections; and a second buffer portion, comprising:

a plurality of second air columns, each stacked on the second surface of the first air column;

a plurality of first connection sides, located at the second air columns, wherein one end of the first connection side is connected to the first heat sealing section, and a first angle is formed between the first connection side and the first air column;

a plurality of second connection sides, located at the second air columns, and disposed at an interval from the first connection sides, wherein one end of the second connection side is connected to the second heat sealing section, and a second angle is formed between the second connection side and the first air column; and a corner area, with one end connected to the first connection side and the other end connected to the second connection side, and used for abutting against an inner surface of a case body, wherein a buffer slot is formed between the second air column and the first air column, and when the article abuts against the first air columns, the first air columns buffer and protect the article, and the buffer slot is compressed due to the pressure and assists in buffering and protecting the article.

2. The buffer air column with a three-dimensional structure according to claim 1, wherein a third angle is formed at a junction of the corner area, the first connection side and the second connection side, and faces the first air columns.

3. The buffer air column with a three-dimensional structure according to claim 1, further comprising a plurality of third connection sides, each with one end connected to the first connection side, and the other end connected to the second connection side.

4. The buffer air column with a three-dimensional structure according to claim 3, wherein the third connection sides are substantially parallel to the first air columns.

5. The buffer air column with a three-dimensional structure according to claim 3, wherein a fourth angle is formed at an junction of the third connection side and the first connection side, a fifth angle is formed at a junction of the third connection side and the second connection side, and the fourth angle and the fifth angle face the first air column.

6. A buffer air column with a three-dimensional structure, comprising:

a first buffer portion, bent to form an accommodation space, used for accommodating an article, and comprising:

a plurality of first air columns, each comprising a first surface and a second surface opposite each other, wherein the second surface is an inner surface for abutting against a case body;

a plurality of first heat sealing sections, for heat-sealing the first air columns;

a plurality of second heat sealing section, for heat-sealing the first air columns, and disposed at an interval from the first heat sealing sections; and a second buffer portion, comprising:

a plurality of second air columns, each stacked on the first surface of the first air column;

a plurality of first connection sides, located at the second air columns, wherein one end of the first connection side is connected to the first heat sealing section, and a first angle is formed between the first connection side and the first air column;

a plurality of second connection sides, located at the second air columns, disposed at an interval from the first connection sides, wherein one end of the second connection side is connected to the second heat sealing section, and a second angle is formed between the second connection side and the first air column; and a corner area, with one end connected to the first connection side, and the other end connected to the second connection side, and used for abutting against the article, wherein a buffer slot is formed between the second air column and the first air column, and when the article abuts against the second air columns, the second air columns buffer and protect the article, and the buffer slot is compressed due to the pressure and assists in buffering and protecting the article.

7. The buffer air column with a three-dimensional structure according to claim 6, wherein a third angle is formed at a junction of the corner area, the first connection side and the second connection side, and faces the first air column.

8. The buffer air column with a three-dimensional structure according to claim 6, further comprising a plurality of third connection sides, each with one end connected to the first connection side, and the other end connected to the second connection side.

9. The buffer air column with a three-dimensional structure according to claim 8, wherein the third connection sides are substantially parallel to the first air columns.

10. The buffer air column with a three-dimensional structure according to claim 8, where a fourth angle is formed at a junction of the third connection side and the first connection side, a fifth angle is formed at a junction of the third connection side and the second connection side, and the fourth angle and the fifth angle face the first air column.

* * * * *